US011304588B2

(12) United States Patent
Dolan

(10) Patent No.: US 11,304,588 B2
(45) Date of Patent: Apr. 19, 2022

(54) SYSTEM, APPARATUS, AND METHOD FOR PROTECTING GLASSWARE

(71) Applicant: Martin Dolan, New York, NY (US)

(72) Inventor: Martin Dolan, New York, NY (US)

( * ) Notice: Subject to any disclaimer, the term of this patent is extended or adjusted under 35 U.S.C. 154(b) by 0 days.

(21) Appl. No.: 15/897,543

(22) Filed: Feb. 15, 2018

(65) Prior Publication Data

US 2018/0235433 A1 Aug. 23, 2018

Related U.S. Application Data

(60) Provisional application No. 62/459,285, filed on Feb. 15, 2017.

(51) Int. Cl.
*A47L 15/50* (2006.01)
*B65D 21/02* (2006.01)

(52) U.S. Cl.
CPC ..... *A47L 15/505* (2013.01); *B65D 21/0233* (2013.01)

(58) Field of Classification Search
CPC ..... A47L 15/505; A47G 19/08; A47G 23/02; A47G 23/0208; A47G 23/0216
See application file for complete search history.

(56) References Cited

U.S. PATENT DOCUMENTS 3,214,031 A * 10/1965 McCauley ..... A47L 15/501 211/41.2
3,778,516 A * 12/1973 Cornelius ..... B65D 1/22 426/119
4,662,512 A 5/1987 Durand
5,579,990 A 12/1996 Durand
6,578,809 B1 6/2003 Dimella
2009/0057257 A1* 3/2009 Marcus ..... B65D 25/20 215/11.6
2010/0090078 A1 4/2010 Vanek et al.
2013/0327366 A1* 12/2013 Godehardt ..... A47L 15/505 134/115 R
2015/0114917 A1* 4/2015 Ammon ..... A47L 15/505 211/41.8
2015/0129002 A1* 5/2015 Park ..... A47J 43/24 134/140
2016/0255975 A1 9/2016 Meline

OTHER PUBLICATIONS

International Preliminary Report on Patentability (IPRP) for Application No. PCT/US18/018299.
International Search Report (ISR) and Written Opinion (WO) dated Apr. 25, 2018 for International Application No. PCT/US18/18299.

* cited by examiner

*Primary Examiner* — Stephen J Castellano
(74) *Attorney, Agent, or Firm* — Ladas & Parry LLP

(57) ABSTRACT

An apparatus for protecting glassware particularly those pieces of glassware having stems from being damaged when placed in a dishwasher or a sink. The apparatus comprises a shroud having an opening at one end to receive the glassware so that the shroud surrounds the glassware, wherein the shroud has at least one perforation on a side thereof and at least one perforation on a top thereof. Multiple shrouds of varying size can be provided which are similar in shape so as to be stackable onto each other.

17 Claims, 14 Drawing Sheets

SYSTEM, APPARATUS, AND METHOD FOR PROTECTING GLASSWARE

CROSS-REFERENCE TO RELATED APPLICATION

The present application claims the benefit of U.S. Provisional Application No. 62/459,285 filed on Feb. 15, 2017 and incorporates the same by reference herein.

BACKGROUND OF THE INVENTION

Field of the Invention

The present invention generally relates to a system, apparatus, and method for protecting glassware whether having stems or not such as wine glasses. More particularly, the present invention relates to an improved system, apparatus, and method for protecting glassware, particularly glassware having stems, from being broken or damaged during the process of loading or unloading a dishwasher, among other applications including packing, securing, storing, or transporting such glassware.

Related Art

Since the advent of the mechanical dishwasher, one unresolved problem has been the challenge in cleaning glassware particularly that having stems—for example, small and large wine glasses, champagne glasses, goblets, etc.—without breaking or damaging the glasses. Such glassware tends to be thinner by nature and thus more easily breakable, and due to having stems is particularly susceptible to damage when in a dishwasher because the stems cause the glasses to be unstable when placed in the dishwasher and thus to rattle back and forth amidst heavy pots and pans. Because of this the stems can break. Moreover, since the stems typically cause the overturned glasses to flop or fall to one side, the glasses become vulnerable to accidental collision from another object during loading and unloading.

There exists, therefore, a need to provide a novel system, apparatus, and method for protecting glassware particularly that having stems that overcomes the above-noted and other problems.

SUMMARY OF THE INVENTION

The present invention provides an improved system, apparatus, and method for protecting glassware having stems, particularly during a mechanical dishwashing process, but the invention is also useful for other applications as well, and indeed the invention of course can protect glassware not having stems.

In one example embodiment of the invention, multi-sized plastic covers or containers are provided which protect glassware, whether having stems or not, when placed in most or all dishwashers. The multi-sized plastic covers, termed "glassware shrouds" herein, have holes or perforations in them so that the glassware underneath can still be cleaned by the dishwasher, both inside and out.

Cleaning glassware having stems in a dishwasher presents a number of problems. A primary problem is that wine glasses don't fit in most top trays due to their height, as most top trays have less height clearance than bottom trays, and in the bottom tray the glasses rattle back and forth amidst heavy pots, pans, plates, and the like. Also, since the stems typically cause the overturned glasses to flop or fall to one side, the glasses become vulnerable to accidental collision from another object during loading or unloading. Due to such factors the stems can break. Of course, in some dishwashers there is more height clearance in the top tray than in the bottom tray, but in either case the glassware shrouds of the present invention can make at least one of the trays of the dishwasher available to protect the stemware.

The above problems can in turn lead to secondary problems, for example broken glass clogging the drain of the dishwasher, and the potential for cut fingers. Moreover, valuable glassware—whether valuable for monetary or sentimental reasons—can be lost from damage or breaking, and common sets of wine glasses can be disrupted.

Because of this, many consumers wash their wine glasses by hand. However, there are drawbacks to this method, as doing so takes time, glasses can break, and when drying by air the glasses are left out on countertops, which itself renders them vulnerable to accidents. During holiday times with crowded kitchen tables and valuable counter space, the risk to wine glasses is even greater, and precious family time is spent washing the glasses instead of spending time with close relations. Wine glasses also are typically not placed in the sink when dirty for fear of them breaking amongst all of the other items that get clanged around in the sink, which also leaves them taking up valuable space on the counter.

One approach to addressing the problem of washing glassware having stems in the dishwasher has been to provide consumers with plastic "clips" which attach the base of the glass to the rack of the dishwasher. However, the applicant of the present application has recognized that this approach has several flaws. First, the clips are small and easy to lose, even when stored nearby. Second, the clips take time to attach, and must be attached correctly and with the right force. Third, the stems of the wine glasses remain vulnerable to other heavier, loose items in the dishwasher. Fourth, the stem clip can leave a small residue on the wine glass.

Another approach to addressing the problem has been to provide a wire-frame rack accessory for hanging or placing wine glasses therein. But this approach takes up more space in the dishwasher and still leaves the glasses vulnerable to pots and pans and other items crashing up against them, particularly during loading and reloading of such other items.

As noted above, in one example embodiment of the present invention, multi-sized plastic covers or "glassware shrouds" are provided which protect glassware (whether having stems or not) in most or all dishwashers. There are several benefits to the glassware shrouds provided by the present invention. First, according to an example embodiment, there can be multiple sizes of glassware shrouds, both in width and height, so that the wine glasses or glassware can be securely but not too snugly housed. Second, a glassware shroud can form a protective boundary around the entire wine glass, which protects the wine glass and the stem from flying loose, as well as protecting the wine glass from other moving objects in the dishwasher. Third, there are holes or perforations in the glassware shroud so that water from the dishwasher can penetrate the glassware shroud and clean the wine glass. Fourth, glassware shrouds are stackable and visible, and easy to store or transport. Fifth, glassware shrouds are used intuitively, unlike clips; the user simply puts the wine glass in the dishwasher as any other glass and then covers the glass with the correct-sized glassware shroud. Sixth, since the entire wine glass is free from contact, it is able to be washed and dried in the dishwasher with no residue attached to the wine glass once the wash and dry cycle is complete. Seventh, glassware shrouds can be used for storage of wine glasses when moving from one residence to another, or even when being placed in the sink before they are cleaned.

The present invention according to one aspect provides an apparatus for protecting glassware comprising a shroud having an opening at one end to receive the glassware so that the shroud surrounds said glassware, wherein the shroud has at least one perforation on a side thereof and at least one perforation on a top thereof. The shroud may be made of a rigid material such as plastic, and may be cylindrical, polygonal, or rectangular in shape, among other shapes (including but not limited to elliptical, hexagonal, octagonal, triangular, etc.).

The present invention according to another aspect provides a system for protecting glassware, comprising a plurality of shrouds each having an opening at one end to receive a piece of glassware so that the shroud surrounds the piece of glassware, wherein each shroud has at least one perforation or hole on a side thereof and at least one perforation on a top thereof The shrouds may be different sizes in width and height. The shrouds may be similar in shape such that the shrouds are stackable onto each other.

The present invention according to another aspect provides a method for protecting glassware, comprising covering the glassware by a shroud having an opening at one end to receive the glassware so that the shroud surrounds the glassware, wherein the shroud has at least one perforation on a side thereof and at least one perforation on a top thereof.

Further features and advantages of the present invention as well as the structure and operation of various embodiments of the present invention are described in detail below with reference to the accompanying drawings.

BRIEF DESCRIPTION OF THE DRAWINGS

The features and advantages of the present invention will be more readily understood from a detailed description of the exemplary embodiments taken in conjunction with the following figures.

Figure 1:
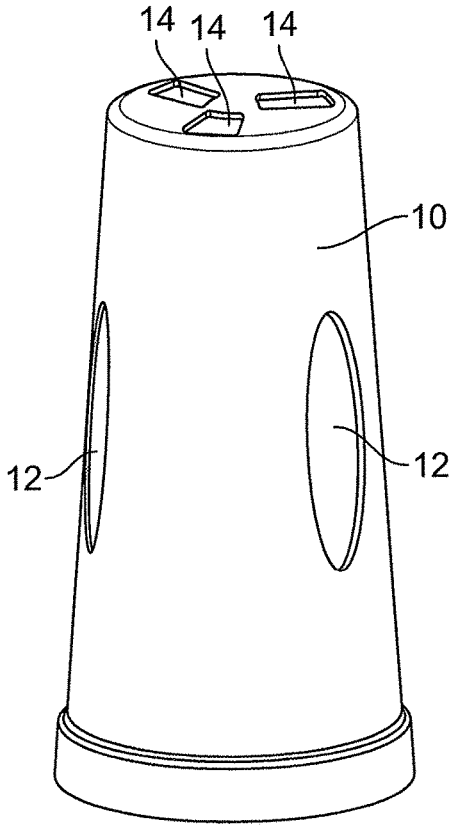
FIG. 1 is a perspective front view of a shroud or cup with a circular cross section, according to an example embodiment of the present invention.

The invention will next be described in connection with certain exemplary embodiments; however, it should be clear to those skilled in the art that various modifications, additions, and subtractions can be made without departing from the spirit or scope of the claims.

DETAILED DESCRIPTION OF THE PREFERRED EMBODIMENTS

The present invention according to one example aspect provides a shroud or casing as a single unit which operates to surround or cover an item such as a wine glass for placement in a dishwasher, sink, storage box, etc. The shroud has one or more holes or perforations to enable water and soap from the dishwasher to clean the glass.

In an example embodiment the shroud is made of a rigid material such as thermoplastic or various injection moldable plastics that do not easily break. Example thermoplastics include acrylic, ABS (acrylonitrile butadiene styrene), PLA (polylactic acid), polycarbonate, polyethylene, polypropylene, polystyrene, Teflon, PVC, and others. Clear, transparent, or translucent plastic are among the examples that can be used, in various colors. In other example embodiments the shroud is made of metal, tin, aluminum, glass, or others including opaque materials. This is not meant to be an exhaustive list and so other suitable materials may of course be used as well, as long as the material has a measure of rigidity sufficient to protect the glassware and can withstand the heat and washing cycle of a dishwasher, which can typically be between 110 and 175 degrees Fahrenheit although could of course be more or less. The shroud may be made in various suitable shapes, sizes, and dimensions. For example, its shape may be cylindrical, polygonal, square, rectangular, or others.

The shroud may be used for the purpose of protecting wine glasses, champagne glasses, goblets, other fine glassware, and the like whether having stems or not, which tend to be thinner in nature and thus more susceptible to damage or breaking than other glass items in the dishwasher.

In preferred example embodiments the glassware shrouds of the present invention are plastic perforated polygonal or round cylinders of different widths and heights which would correspond to dimensions slightly larger than the widths and heights of various wine glasses, champagne glasses, goblets, etc. A full set of glassware shrouds may comprise a number of different widths and heights (e.g., four), although various embodiments of the present invention would of course be made to enable users to acquire subsets appropriately sized for their own sets of small and large wine glasses, champagne glasses, goblets and other glassware, etc.

The glassware shrouds can be molded or made in any suitable dimensions to fit various sized glasses and accommodate various sized or configured dishwasher racks. In some example dishwasher racks (certainly not meant to be limiting), the dishwasher racks are approximately 21" square with upstanding tines arrayed in a variety of patterns with different spacing and angles with respect to the horizontal. The upper and lower racks may be different in height or configuration and may thus present separate challenges that can be met by the present invention. It is noted that commercial Carlisle plastic racks, without tines, in some examples establish 16-35 compartments (rounded and square) from 3.5 inches to 4.5 inches. The glassware shrouds of the present invention provide full depth barriers between glasses and other adjacent glasses or items in dishwashers and envelope each of the glasses. The various dimensions of the glassware shrouds can accommodate a range of commonly used glasses. In one aspect of the invention the glasses are placed in the dishwasher with the glassware shrouds quickly and effectively placed over the glasses and ultimately enveloping the glasses in a simple and easy fashion. At the end of the washing cycle shrouds and glasses can be easily removed.

The glassware shrouds of the present invention are of course dishwasher safe and are stackable within their size category for easy storage. As discussed above the glassware shrouds can simply be put over a piece of glassware once that item is loaded into a dishwasher. The glassware shrouds then allow, via the various openings, holes, or perforations thereof, the water, soap, and rinse cycles access to the glassware while protecting the stem from vibrations and protecting the glass and stem from contact with any loose items which may be dislodged in a dishwasher. A typical wine glass enveloped by a glassware shroud is thereby stabilized in the dishwasher and thus protected from contact by adjacent glasses, pots, and pans, while accommodating water circulation. A glassware shroud also offers protection to the wine glass even if the wine glass is in a sink or on a counter or if wine glasses are stored together in a crate or box.

The manufacturing process according to one embodiment of the present invention results in glassware shrouds having (1) a tapered (or in some embodiments frustoconical) cylinder or other shaped body which allows for relatively easy injection molding; and (2) sufficient hole openings or perforations for dishwasher spray yet strong enough to shroud and protect the glassware.

According to preferred aspects of the present invention the thickness of the glassware shrouds is 0.06 inches which is a wall thickness that accommodates well the plastic injection molded parts. In other preferred embodiments the thickness of the glassware shrouds may be but are not limited to 0.05 or 0.07 inches with no effect on the performance. Thicknesses more or less than these are suitable as well. In one example embodiment the height of a glassware shroud is approximately 8 inches, but of course heights taller or shorter than this are suitable as well.

As to the shape of the holes or perforations, the bigger the hole, the more surface area is exposed to the cleaning power of the dish washer, but the weaker the structure. The design of the present invention balances the mechanical strength of the product with the exposed area of the glasses.

The strength of the product is a resultant of the material selected and the geometry produced. The present invention in one embodiment is a stackable design which holds the glass in place as well as keeps a large part of the glass exposed to the environment of the dishwasher.

In the accompanying figures it is of course to be understood that like reference numerals refer to similar (though not necessarily identical) components.

FIG. 1 is a perspective view of a glassware shroud 10 in the form of a cylindrical shroud or cup with a circular cross section, according to an example embodiment of the present invention. The glassware shroud 10 has holes or perforations 12 on its side, to allow water and soap from the dishwasher to have access to the glassware contained therein, for cleaning. Perforations 14 on the top of the glassware shroud 10 operate to provide the same function, as does the opening 15 at the bottom (see FIG. 2).

As can be seen for example from the embodiment of FIG. 1, the full opening 15 at the bottom of the glassware shroud 10 which receives the glass enables a good washing of the inside of the glass, while the side perforations 12 or the top perforations 14 enable washing of the outside of the glass.

Figure 2:
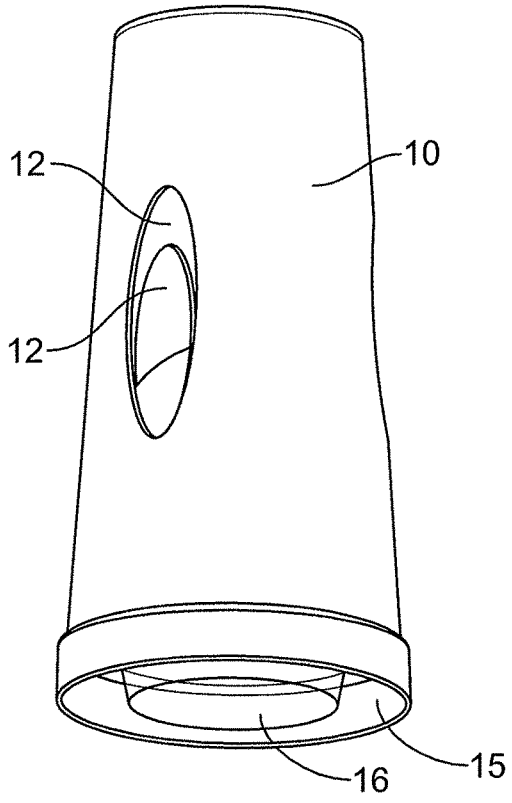
FIG. 2 is another perspective view of the shroud of FIG. 1, tilted upwards, and shows a wine glass contained therein.
Figure 3:
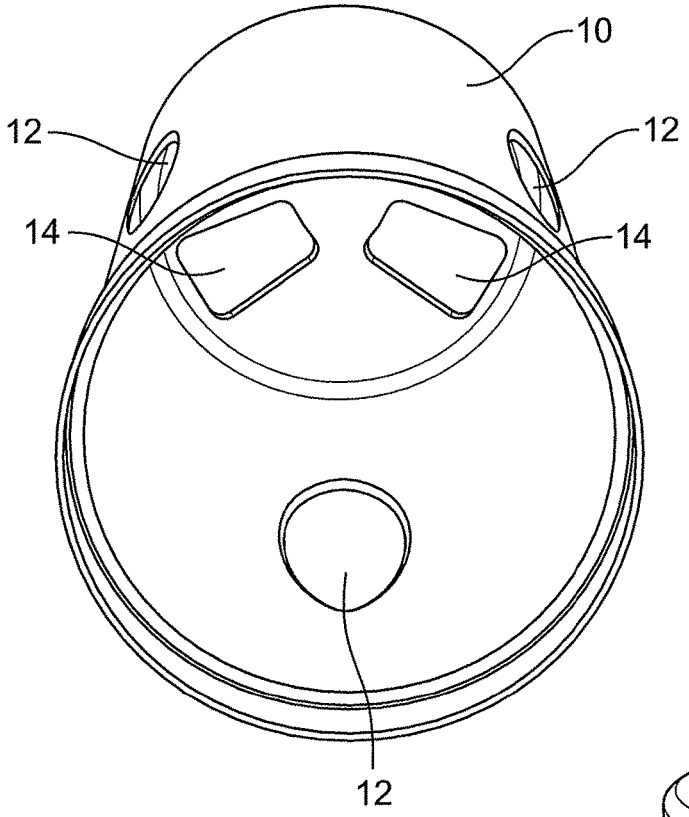
FIG. 3 is a perspective bottom view of the shroud of FIGS. 1 and 2.

FIG. 2 is a perspective front view of the glassware shroud 10 of FIG. 1, tilted upwards, and shows a wine glass 16 contained therein and protected thereby. FIG. 3 is a perspective bottom view of the glassware shroud 10 of FIGS. 1 and 2.

Of course, the perforations may vary in size, shape, and number as well. See for example FIGS. 4-8, which show another example embodiment of the present invention, in which like reference numerals are used to point to like features.

Figure 4:
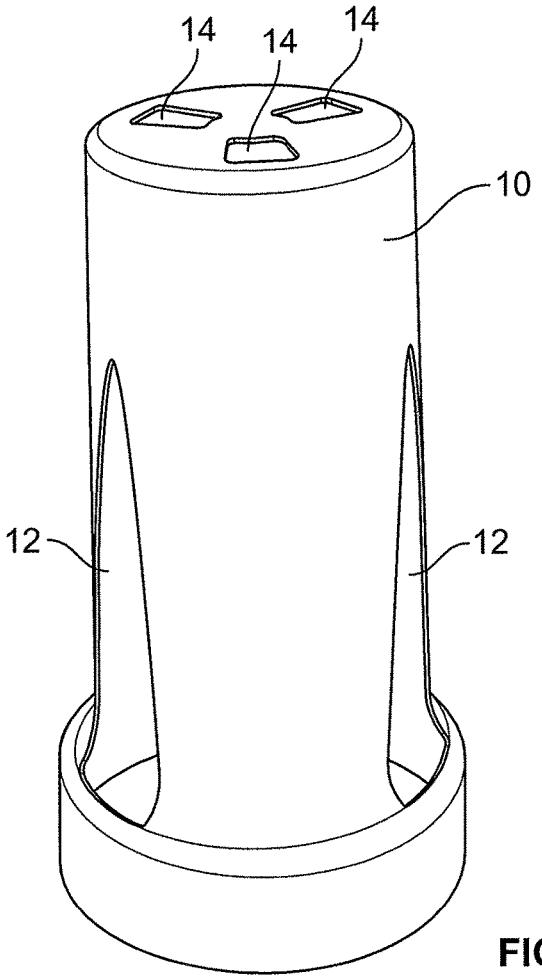
FIG. 4 is a perspective front view of a shroud or cup with a circular cross section, according to another example embodiment of the present invention.

FIG. 4 is a perspective front view of a shroud or cup 10 with a circular cross section, according to another example embodiment of the present invention. As can be seen in FIGS. 4-8 the holes or perforations 12 on the side of the shroud 10 have a different shape and size than the holes or perforations 12 of FIGS. 1-3. The perforations 14 on the top of the shroud 10 of FIGS. 4-8 are similar to the perforations 14 of the example embodiment of FIGS. 1-3, but of course, like the side perforations 12, the top perforations 14 of FIGS. 4-8 could vary in size, shape, configuration, or number as well (e.g., round, elliptical, rectangular, etc.).

Figure 5:
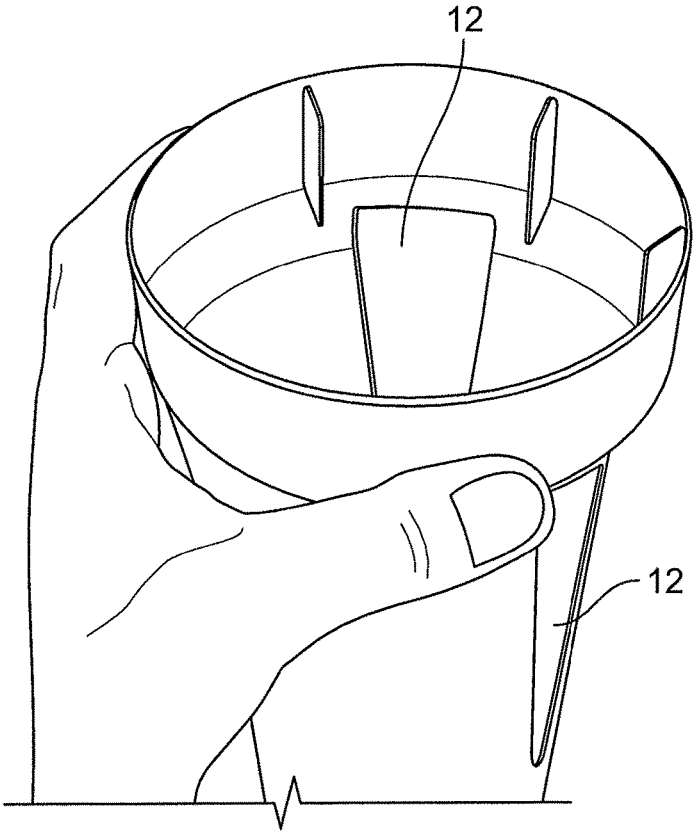
FIG. 5 is a view of the shroud of FIG. 4, inverted and showing a portion of the inside of the shroud.

FIG. 5 is a view of the shroud 10 of FIG. 4, inverted and showing a portion of the inside of the shroud 10. The embodiment of FIG. 5 for example shows a plurality of tabs on the inside rim (made, for example, from a soft material such as rubber, or another material such as plastic) which can help stabilize the glassware snugly within the shroud 10. In some embodiments other material (soft, plastic, rubber, etc.) on the inside surface of the shroud can help stabilize the glassware snugly within the shroud as well.

Figure 6:
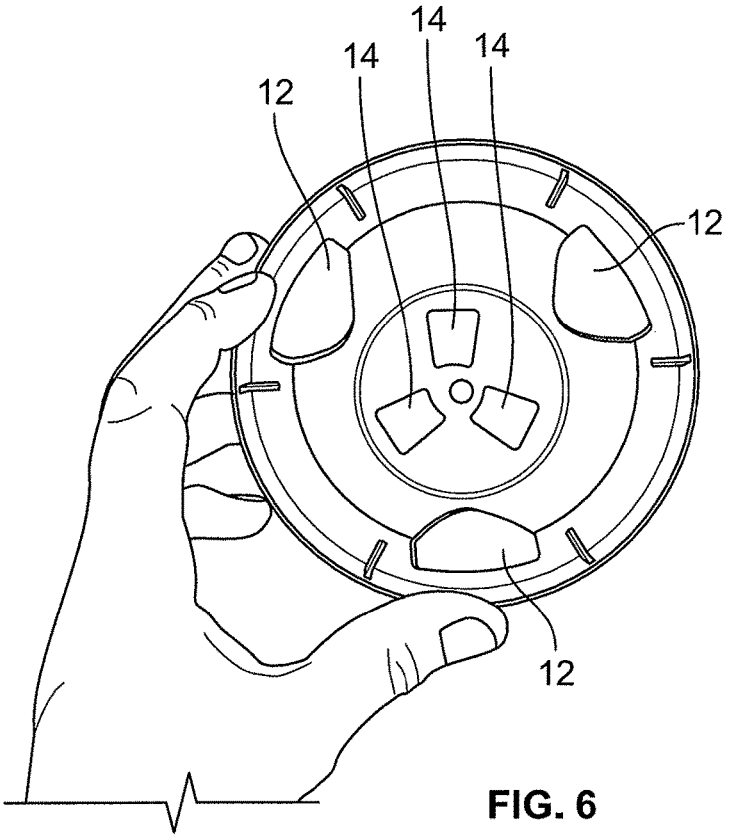
FIG. 6 is a bottom view of the shroud of FIG. 4.
Figure 7:
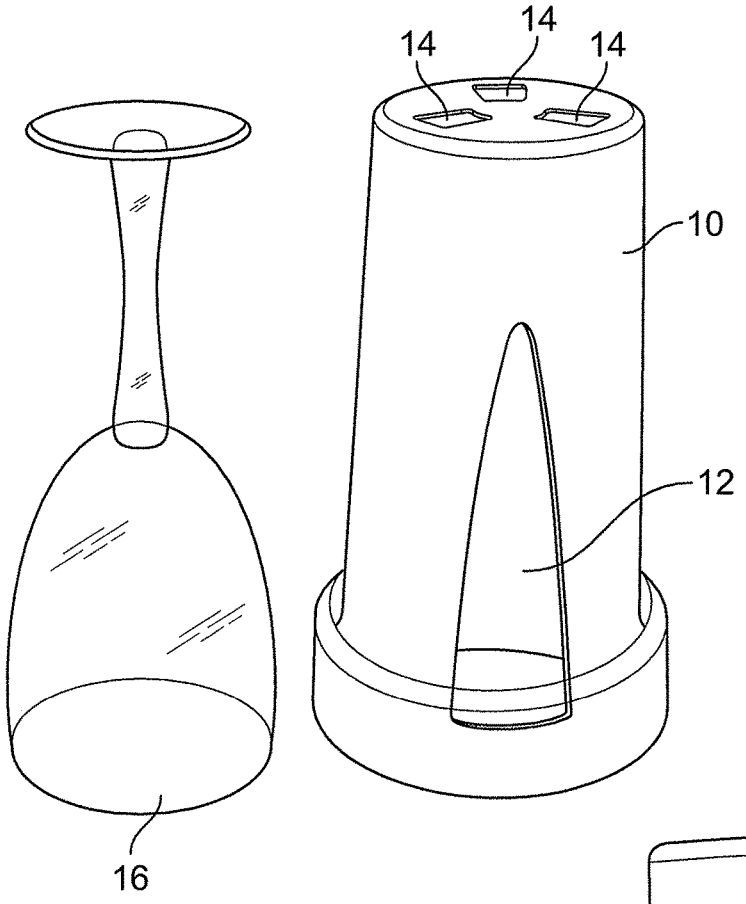
FIG. 7 is another perspective view of the shroud of FIG. 4, shown adjacent to an inverted wine glass that fits inside the shroud.
Figure 8:
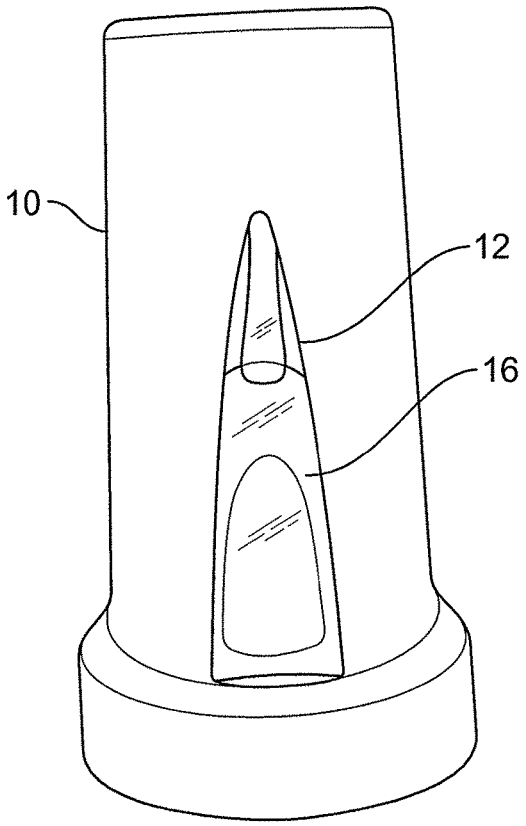
FIG. 8 shows the wine glass from FIG. 7 enveloped by the shroud.

FIG. 6 is a bottom view of the shroud 10 of FIG. 4. FIG. 7 is another perspective view of the shroud 10 of FIG. 4, shown adjacent to an inverted wine glass 16 that fits inside the shroud 10. FIG. 8 shows the wine glass 16 from FIG. 7 enveloped by the shroud.

Figure 9:
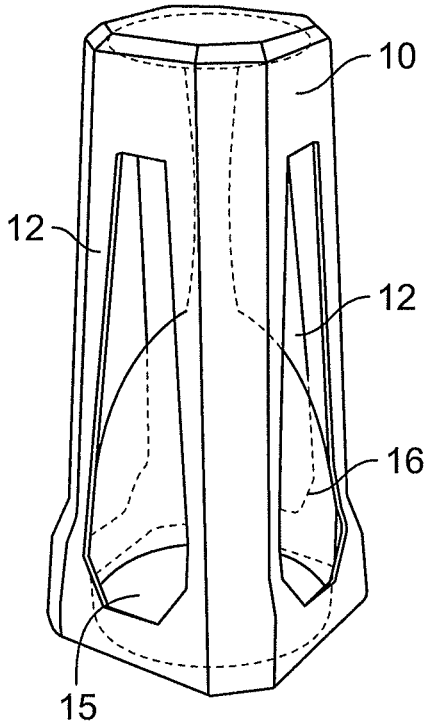
FIGS. 9-11 show a glassware shroud having a polygonal cross section in various depictions relative to a wine glass.
Figure 10:
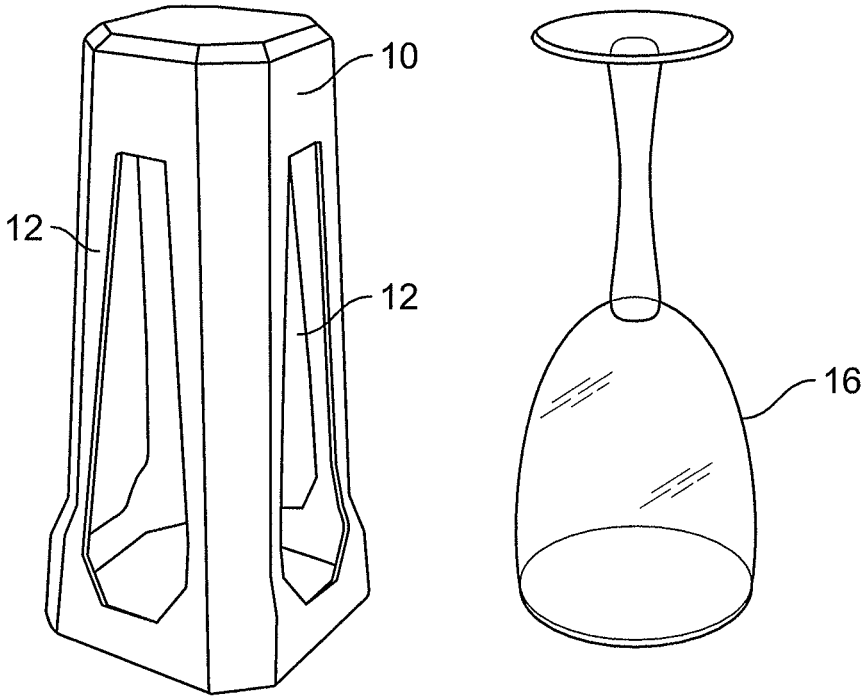
Figure 11:
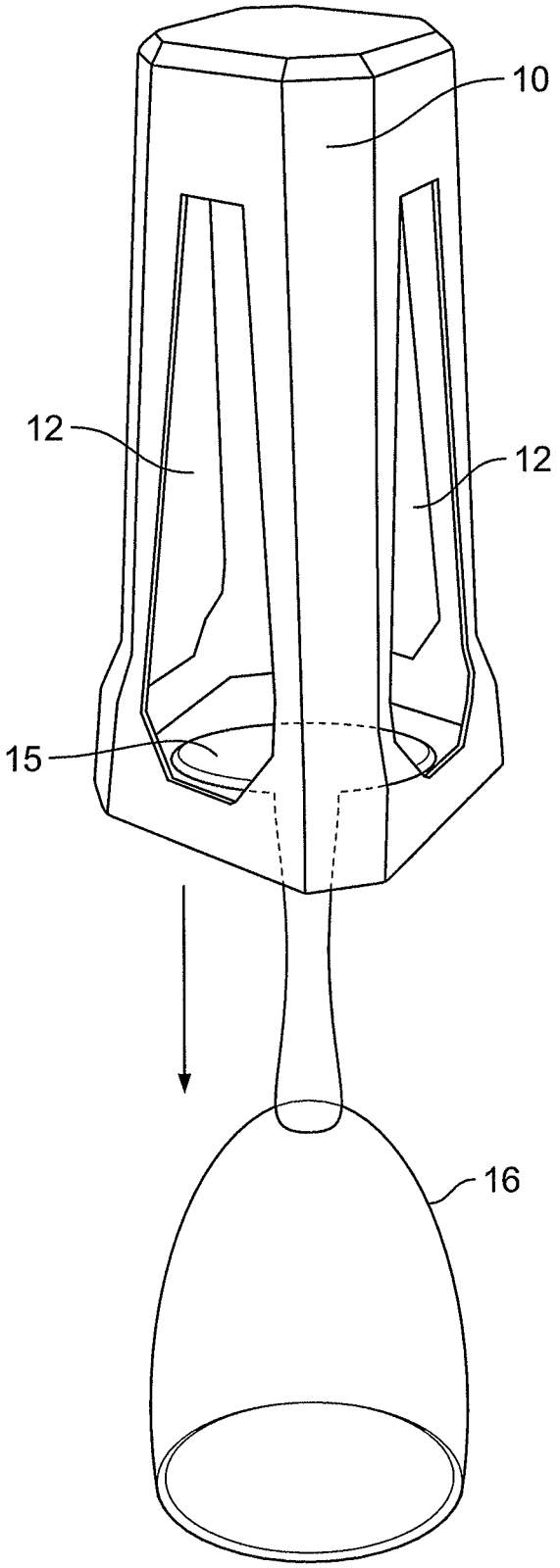

FIGS. 9-11 show a glassware shroud 10 having a polygonal cross section. FIG. 9 shows how a glass 16 is enveloped by the shroud 10. FIG. 10 shows the glass 16 adjacent to the shroud 10. FIG. 11 shows how the shroud 10 is placed over the glass 16. Of course, while not shown in FIGS. 9-11 the shroud 10 could of course have holes or perforations on its bottom similar to the holes or perforations 14 of FIG. 1.

Figure 12:
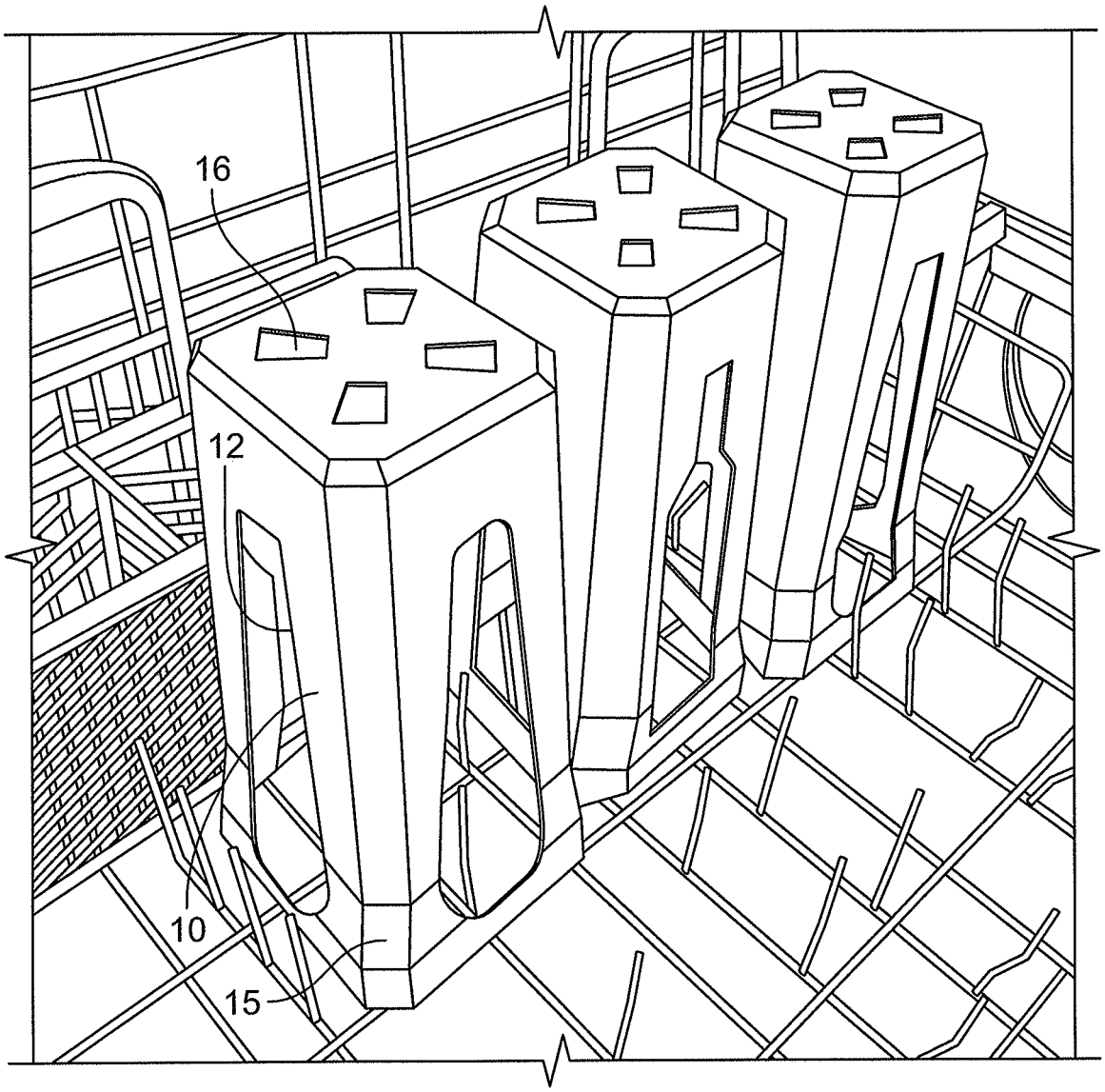
FIG. 12 shows three adjacent polygonal shrouds loaded into a dishwasher, according to another embodiment.

FIG. 12 shows three adjacent polygonal shrouds 10 loaded into a dishwasher, according to another embodiment. It is noted that when placed adjacent to each other circular bottom rims such as those shown in the embodiment of FIG. 1 have, by definition, only a narrow singular meeting point. Consequently, one advantage to shrouds having square or rectangular bottoms or even polygonal bottoms such as those shown in FIG. 12 is that when placed adjacent to each other adjacent shrouds 10 can support each other.

Figure 13:
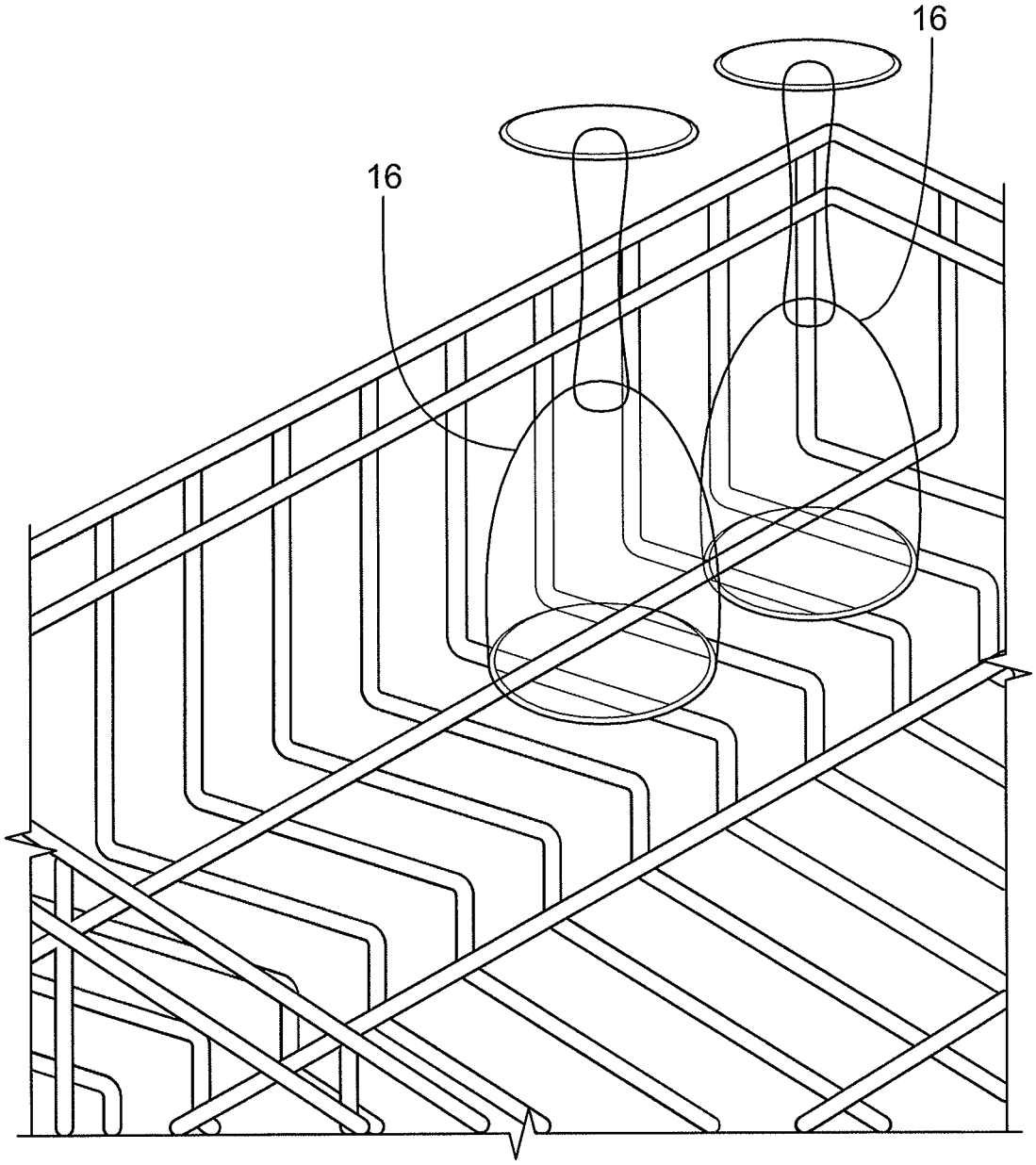
FIGS. 13 and 14 show, respectively, two naked wine glasses loaded in a dishwasher, and then covered by polygonal shrouds.
Figure 14:
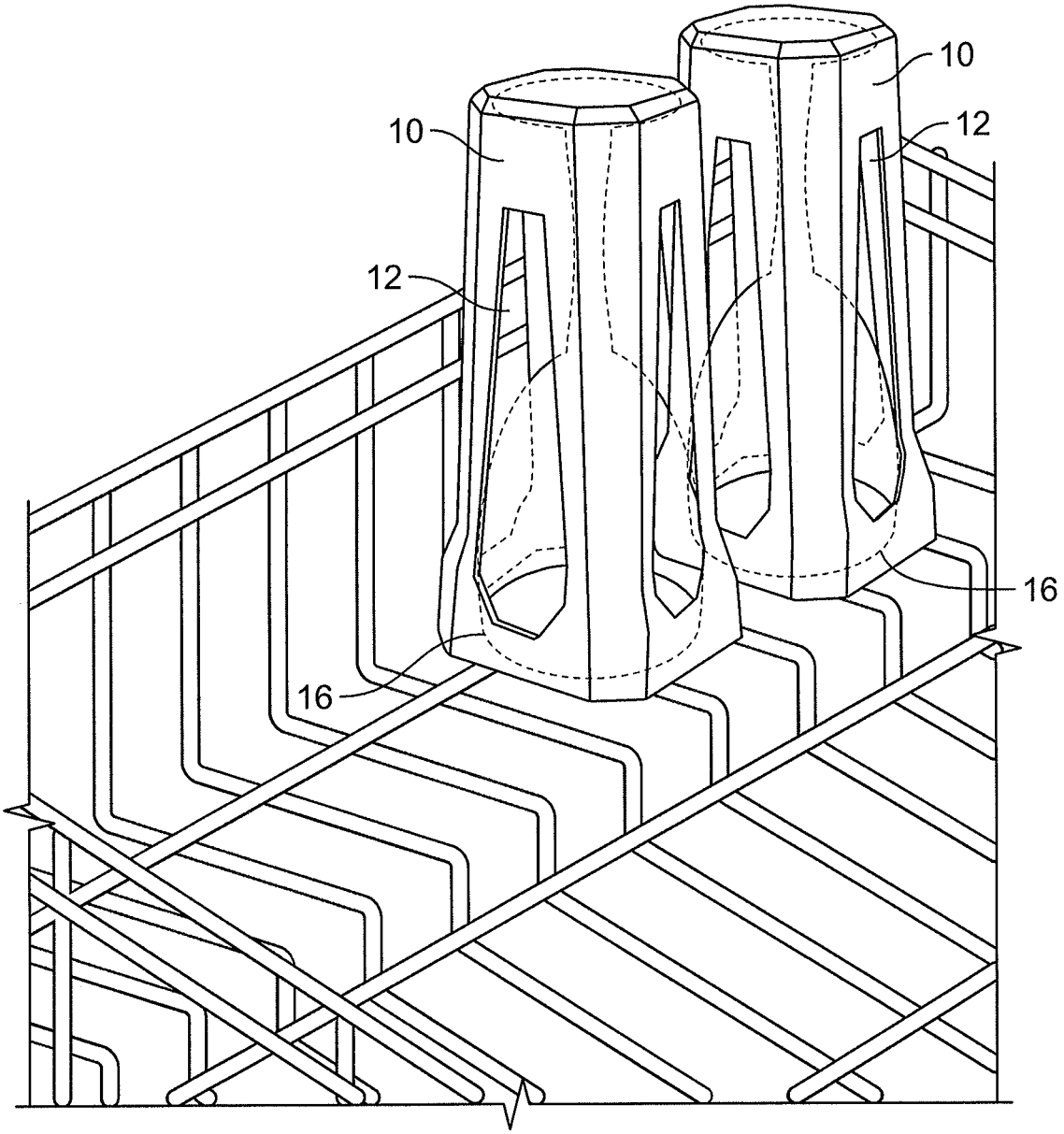
Figure 15:
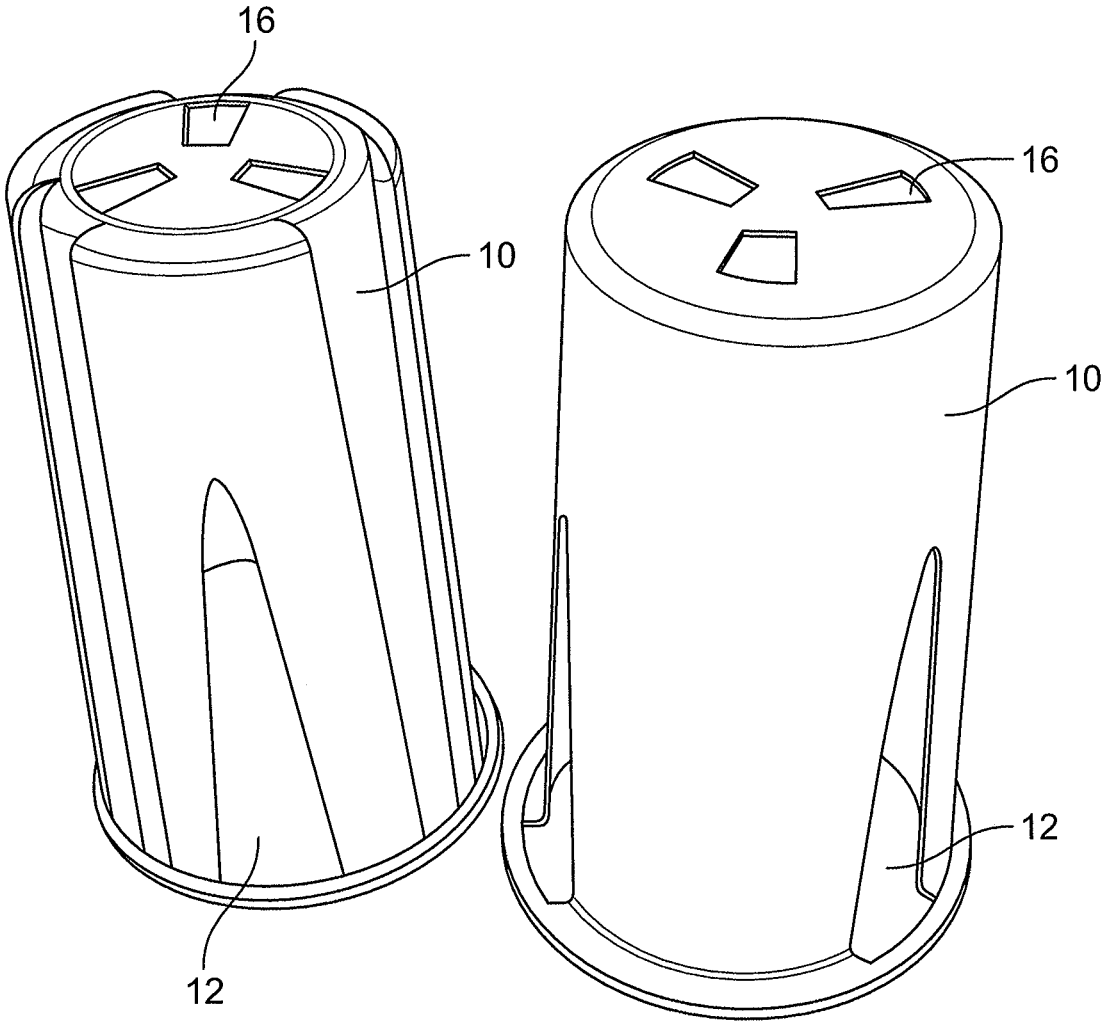
FIG. 15 shows two depictions of a shroud having cylindrical cross section according to another embodiment.
Figure 16:
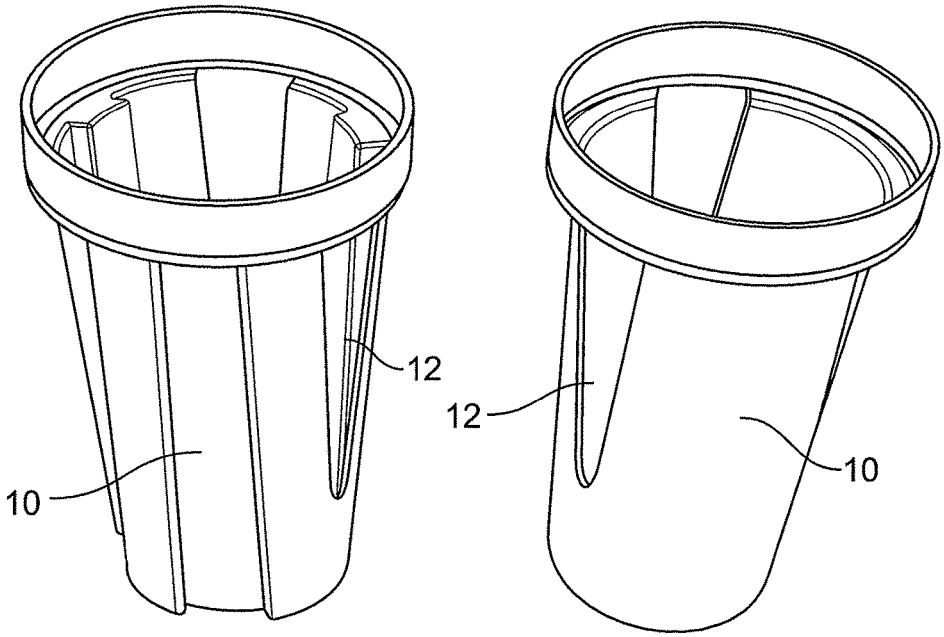
FIGS. 16-17 show further depictions of a cylindrical shroud according to the present invention.
Figure 17:
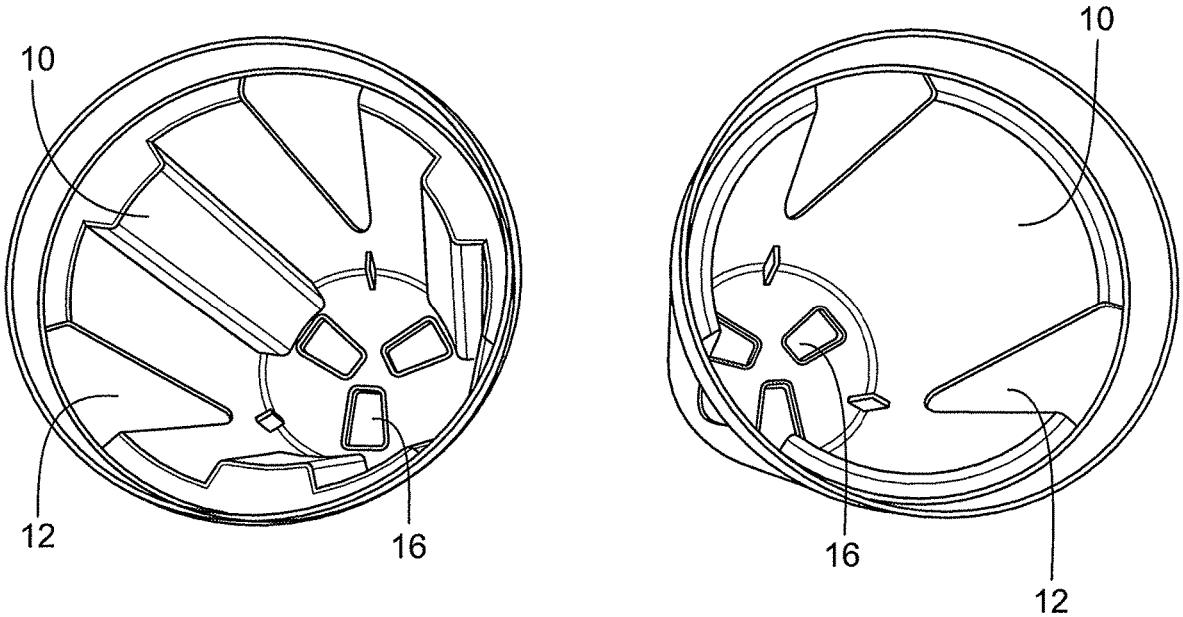
Figure 18:
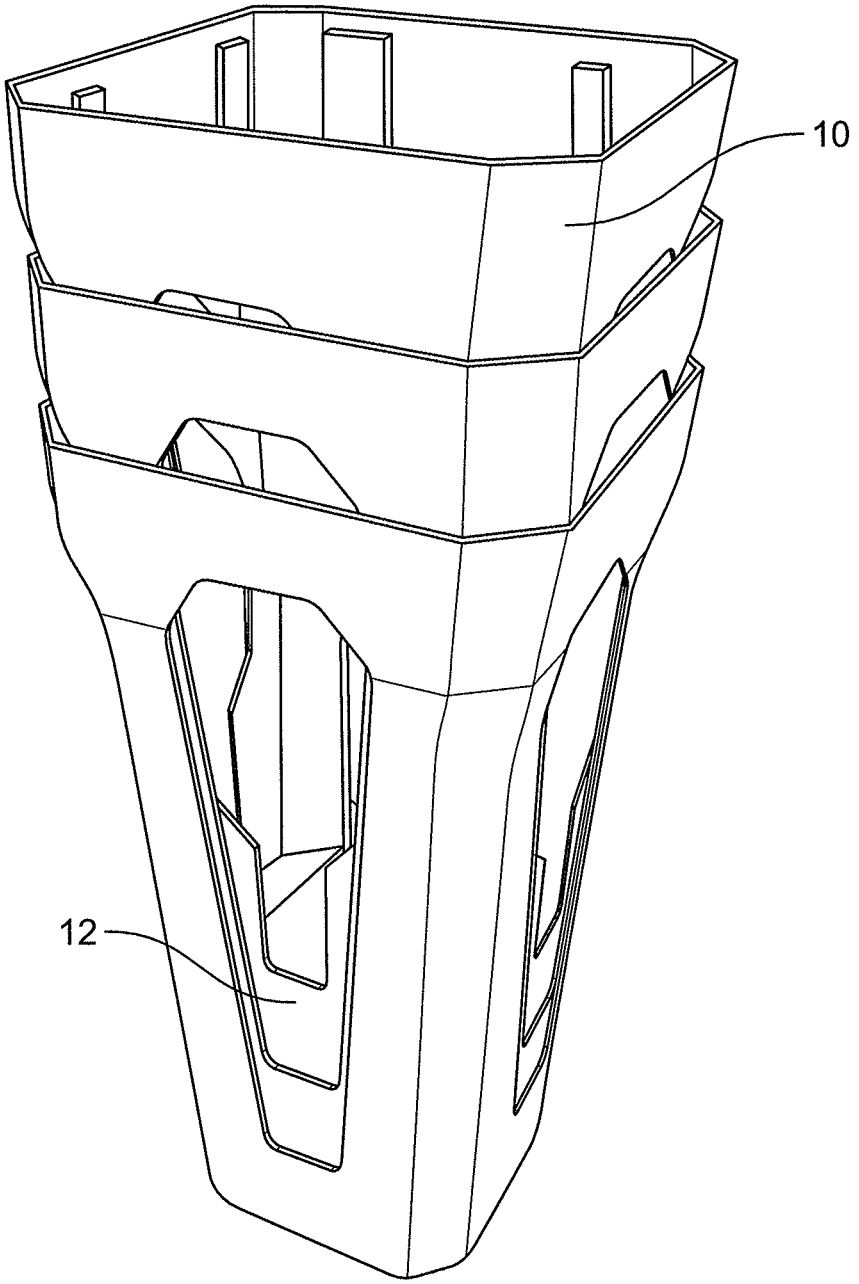
FIGS. 18-20 show stackable shrouds of polygonal or substantially rectangular cross section according to the present invention.
Figure 19:
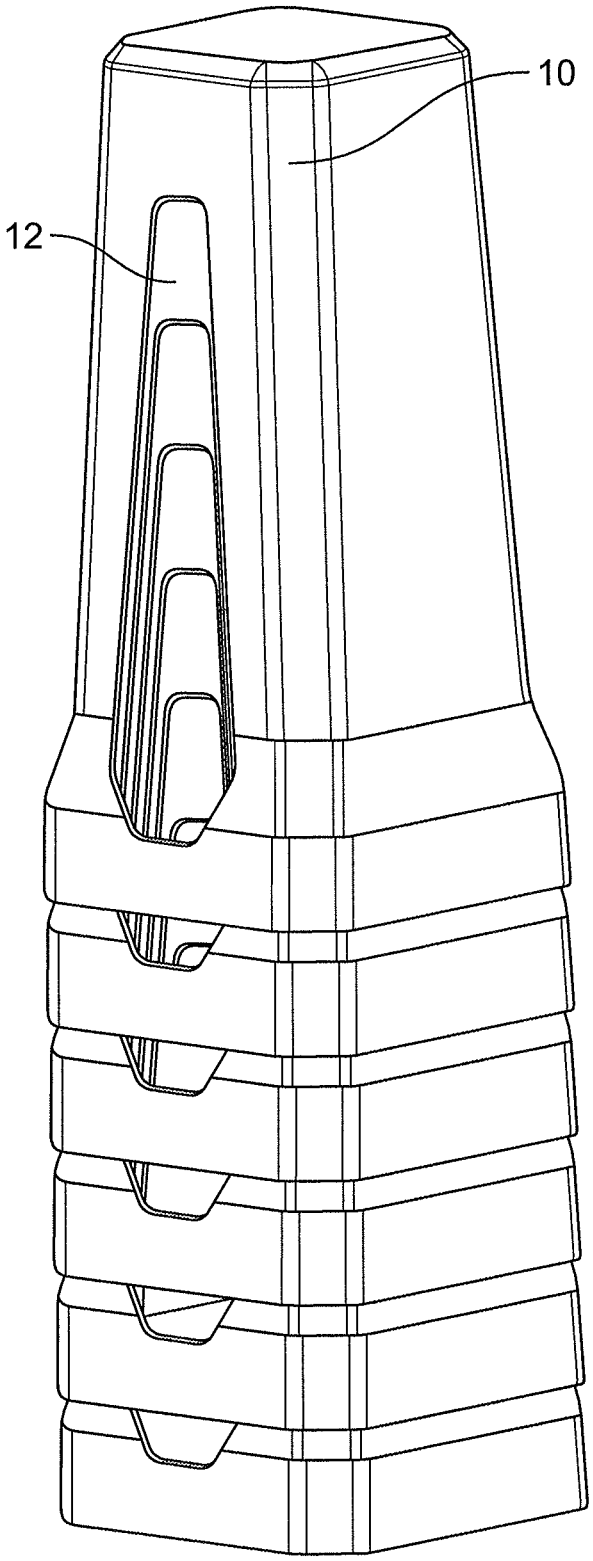
Figure 20:
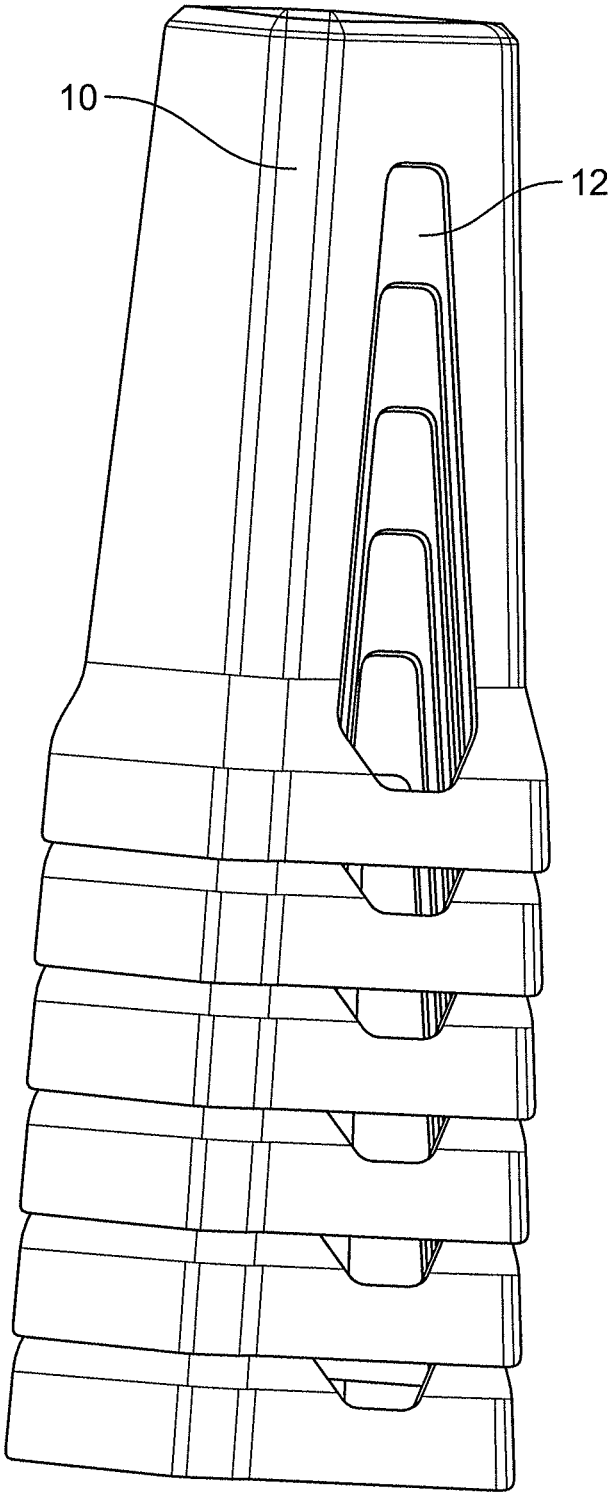

FIGS. 13 and 14 show, respectively, two naked wine glasses 16 loaded in a dishwasher, and then covered by polygonal shrouds 10. FIG. 15 shows two depictions of a shroud 10 having cylindrical cross section according to another embodiment. FIGS. 16-17 show further depictions of a cylindrical shroud 10 according to the present invention. FIGS. 18-20 show stackable shrouds 10 of polygonal or substantially rectangular cross section according to the present invention.

The shrouds can of course be manufactured in any color. Black for example looks good and strong in the context of a gray and silver dishwasher interior, and someone may be less likely to accidentally discard a black shroud but translucent ones might get discarded in error.

As will be appreciated from the description and figures herein, as wine glasses and other types of fine glassware are ubiquitous in households and restaurants, particularly those with electric dishwashers, the invention finds wide application. Individuals, restaurants, and caterers, to name some, may therefore find this invention to be quite useful.

Glassware shrouds according to the present invention and its various embodiments can be made available separately or in a set that is stackable together and that has varying shapes and sizes. They may of course be sold as standard accessories or equipment accompanying glassware or even along with an electric dishwasher. Some modest universality of size is envisioned in some embodiments so that a single glassware shroud can fit several different sizes, configurations, and types of glasses. As noted above the shrouds may protect glassware with or without stems.

The shrouds can be circular, polygonal, square, or rectangular in cross section, among other shapes and configurations as noted herein. By virtue of the features of the present invention adjacent glasses can be placed on a dishwasher rack, each glass being protected or enveloped by a shroud, such that each glass is stabilized as well as separate from each adjacent glass.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. Thus, the present invention should not be limited by any of the above-described exemplary embodiments.

What is claimed is:

1. An apparatus for protecting a single glassware article, comprising:

a shroud having a bottom opening at one end to receive the single glassware article as the shroud is placed over and down upon the single glassware article and having lateral sides that are configured to surround all lateral sides and the top of the single glassware article in a close proximal manner and spaced apart from the single glassware article, wherein the bottom opening forms a continuous perimeter at said one end, wherein said shroud has at least one perforation on a side thereof and at least one perforation on a top thereof, wherein said shroud is made of a rigid material that is able to withstand water, soap, and heat processes of a dishwasher, wherein said shroud is portable and is a single unit, and the internal capacity of the shroud is sized for only one glassware article.

2. The apparatus of claim 1, wherein said shroud is cylindrical in shape.

3. The apparatus of claim 1, wherein said shroud is polygonal or rectangular in shape.

4. The apparatus of claim 1, further comprising a plurality of tabs on an inside surface of said shroud.

5. The apparatus of claim 4, wherein the plurality of tabs are made from plastic or rubber.

6. The apparatus of claim 1, wherein said shroud is tapered or frustoconical in shape.

7. A method for protecting a single glassware article, comprising:

covering the single glassware article with a shroud having a bottom opening at one end to receive the single glassware article as the shroud is placed over and down upon the single glassware article, said shroud having lateral sides that are configured to surround all lateral sides and the top of the single glassware article in a close proximal manner and spaced apart from the single glassware article, wherein the bottom opening forms a continuous perimeter at said one end, wherein said shroud has at least one perforation on a side thereof and at least one perforation on a top thereof, wherein said shroud is made of a rigid material that is able to withstand water, soap, and heat processes of a dishwasher, and wherein said shroud is portable and is a single unit, and the internal capacity of the shroud is sized for only one glassware article.

8. The method of claim 7, wherein said shroud is cylindrical in shape.

9. The method of claim 7, wherein said shroud is polygonal or rectangular in shape.

10. The method of claim 7, wherein the glassware article has a stem.

11. A system for protecting glassware articles, comprising:

a plurality of shrouds, each shroud for protecting a single glassware article and having a bottom opening at one end to receive the single glassware article as the shroud is placed over and down upon the single glassware article and having lateral sides that are configured to surround all lateral sides and the top of the single glassware article in a close proximal manner and spaced apart from the single glassware article, wherein the bottom opening forms a continuous perimeter at said one end, wherein each shroud has at least one perforation on a side thereof and at least one perforation on a top thereof, wherein each shroud is made of a rigid material that is able to withstand water, soap, and heat processes of a dishwasher, wherein each shroud is portable and is a single unit, and the internal capacity of the shroud is sized for only one glassware article, and wherein said shrouds are similar in shape such that said shrouds are stackable onto each other.

12. The system of claim 11, wherein each shroud is cylindrical in shape.

13. The system of claim 11, wherein each shroud is polygonal or rectangular in shape.

14. The system of claim 11, wherein said shrouds are different sizes in width and height.

15. The system of claim 11, further comprising a plurality of tabs on an inside surface of each shroud.

16. The system of claim 15, wherein the plurality of tabs are made from plastic or rubber.

17. The system of claim 11, wherein each shroud is tapered or frustoconical in shape.

* * * * *